US007091870B2

(12) United States Patent
Tsutsumi et al.

(10) Patent No.: US 7,091,870 B2
(45) Date of Patent: Aug. 15, 2006

(54) SECURITY SYSTEM AND METHOD OF SECURITY SERVICE BUSINESS

(75) Inventors: Hirofumi Tsutsumi, Tokyo (JP); Keiko Nakashige, Hitachi (JP); Seiji Tanaka, Hitachinaka (JP); Yoshihiro Nishikawa, Hitachi (JP); Yasuaki Takada, Kiyose (JP); Toshihiko Ohta, Taketoyo (JP); Akio Torii, Tokyo (JP); Tomoyuki Hisada, Taketoyo (JP); Kenji Kusumoto, Taketoyo (JP)

(73) Assignees: Hitachi, Ltd., Tokyo (JP); NOF Corporation, Tokyo (JP)

( * ) Notice: Subject to any disclaimer, the term of this patent is extended or adjusted under 35 U.S.C. 154(b) by 865 days.

(21) Appl. No.: 10/078,374

(22) Filed: Feb. 21, 2002

(65) Prior Publication Data

US 2003/0009661 A1 Jan. 9, 2003

(30) Foreign Application Priority Data

Jul. 5, 2001 (JP) ..... 2001-204668

(51) Int. Cl.
*G08B 17/10* (2006.01)

(52) U.S. Cl. ..... 340/632; 340/633; 250/288

(58) Field of Classification Search ..... 340/632, 340/633, 634, 630, 577; 356/51, 338.5, 437, 356/439; 702/22, 28; 250/338.1, 338.5, 250/281, 282, 287, 288
See application file for complete search history.

(56) References Cited

U.S. PATENT DOCUMENTS

| | | | | |
|---|---|---|---|---|
| 4,008,388 A | | 2/1977 | McLafferty et al. | 702/27 |
| 4,795,253 A | * | 1/1989 | Sandridge et al. | 356/51 |
| 4,999,498 A | * | 3/1991 | Hunt et al. | 250/338.5 |
| 5,068,798 A | * | 11/1991 | Heath et al. | 702/28 |
| 5,452,234 A | * | 9/1995 | Heath et al. | 702/22 |
| 6,147,348 A | | 11/2000 | Quarmby et al. | 250/292 |

FOREIGN PATENT DOCUMENTS

| | | |
|---|---|---|
| EP | 1093151 | 4/2001 |
| JP | 57-148866 | 9/1982 |
| JP | 04-129157 | 4/1992 |
| JP | 09-118428 | 5/1997 |
| JP | 10-334161 | 12/1998 |
| JP | 11-014576 | 1/1999 |
| JP | 2000-028579 | 1/2000 |
| JP | 2001-108673 | 4/2001 |

* cited by examiner

*Primary Examiner*—Van T. Trieu
(74) *Attorney, Agent, or Firm*—Mattingly, Stanger, Malur & Brundidge, P.C.

(57) ABSTRACT

A terminal system has a mass spectrometric for inspecting of dangerous substances is installed in an inspection area, and a support system for determining whether or not a dangerous substance is present and identifying the type of the substance, based on the mass spectrometric data on the target element that has been measured by the mass spectrometric, is installed in a security service enterprise's office. Both systems are connected to each other via a communication network so that they can exchange information. Thus, the support system can send the determination result of dangerous substances and a precautions guide to the terminal system via the communication network.

9 Claims, 10 Drawing Sheets

SECURITY SYSTEM AND METHOD OF SECURITY SERVICE BUSINESS

BACKGROUND OF THE INVENTION

The present invention relates to a security system and a method of security service business, for example, relates to a system for inspecting for the presence or absence of a dangerous substance in a parcel, cargo, or a suspicious object in order to secure safeguard against dangerous substances. In this specification, "dangerous substance" means gunpowder which includes explosives, poisonous gases and inflammables.

At places where many people gather, such as airports and event sites, parcel inspections are generally conducted by using X-ray or metal detectors to ensure safety of passengers and event participants. When there is a possibility that an explosive or some other dangerous substances may be armed, an inspection must be performed to determine whether or not a dangerous substance exists, however, dangerous substance inspection devices are not commonly used yet. Currently, when there is a possibility that an explosive or some dangerous substances may be armed, it is common to summon professionals, who inspect for the presence or absence of a dangerous substance. This kind of dangerous substance inspection is required for inspecting parcels handled by door-to-door delivery services or inspecting a suspicious object in a bank's safety-deposit box.

The two most well-known and commonly used methods to detect dangerous substances are the gas chromatograph method and the mass spectrometric method. Both methods sample (sampling) any trace of gas emitting from a parcel or a suspicious object, analyze the sampled gas (sample gas), and inspect for the presence or absence of an element that is a part of a dangerous substance, such as an explosive.

The principle of the gas chromatograph method is as follows: A silica column having a treated inner surface, an iron column filled with adsorbent, or a glass column is heated and a sample gas is injected into it, and then, a carrier gas, such as nitrogen, helium or hydrogen, is injected into the column. This causes each element of the sample gas to separate and flow out from the column because of the difference of the boiling point or the difference of affinity between inner-surface treatment or filler material. This means that each element contained in the sample gas moves in the column at a different speed and therefore each element flows out from the column at a separate rate. The gas chromatograph method properly measures the degree of heat conductivity of the elements that separately flow out, confirms the mixing state of the sample and analyzes the elements.

RDX and TNT, the commonly used explosives, are usually identified by detecting $NO_2$ which is an element of the explosives. However, $NO_2$ is only one element in the explosive and it is difficult to confirm the structure of the compound based on the element. Therefore, reference data is obtained beforehand and relative comparison with the outflow time is conducted, and then it is determined whether or not a substance is an explosive, and in case of an explosive, the type of the explosive is identified. It takes several minutes to conduct a series of detecting processes. Also, a large amount of labor is required to maintain the device including the acquisition of the reference data for conducting relative comparison.

The mass spectrometric method ionizes a sample gas and measures the mass of the ion (accurately, the value m/z which has been obtained by dividing the ion mass m by electric charge z) by using a mass spectrometer placed in the vacuum. The mass spectrometer is classified into two types: a quadrupole mass spectrometer and an ion trap mass spectrometer.

The quadrupole mass spectrometer is a mass spectrometer which consists of four bar-shaped electrodes, wherein an electric field is formed at each electrode by the application of the direct current voltage and the high frequency voltage being superimposed. The ionized molecules of a sample gas are introduced to the electric field. Ions that pass through the electric field vibrate in three-dimensionally complicated behaviors, and only those ions that have a m/z ratio corresponding to the applied direct current voltage and high-frequency voltage are able to pass through the electric field and be detected. Other ions collide with one of the electrodes and become extinct. As a result, it is possible to obtain a spectrum by keeping the ratio of the direct current voltage and the high-frequency voltage constant and scanning the ions.

The ion trap mass spectrometer consists of two end cap electrodes and one ring electrode. When ionized molecules of a sample gas are introduced into an area within these three electrodes, the ions are enclosed (i.e. trapped) in the electric field which has been formed by the high frequency voltage applied to the ring electrode. The trapped ions are released according to their mass as a result of being scanned by another high frequency voltage which has been applied to the end cap electrodes. Accordingly, it is possible to obtain a spectrum by detecting the released ions. Ions are stored in the electric field and released after a certain time duration (e.g. dozens of msec order). This integrated effect makes it possible to attain supersensitivity.

By analyzing the mass spectrum data of a sample gas obtained in the manner mentioned above, it is possible to inspect for the presence or absence of a mass spectrum which is characteristic of a dangerous substance, such as explosives, which might be present in the sample gas. Consequently, it is possible to determine the presence or absence of a dangerous substance, such as explosives, and if such a substance exists, the type of the substance can be identified. This method requires only several seconds to detect an explosive (e.g. 3 to 8 seconds). Especially, the mass spectrometric method is highly reliable and its reliability can be increased further by employing a multiplex analysis which repeatedly conducts mass spectrometric processes by separating only ions (parent ion) characteristic of explosives from an ion mixture, activating the parent ions, and then detecting fragment ions (daughter ion) coming from the parent ions.

SUMMARY OF THE PRESENT INVENTION

Although it is required to detect dangerous substances during parcel inspections at airports or event sites, for door-to-door delivery services, or an inspection of a suspicious object located in a bank's safety-deposit box, detection of dangerous substances is not common yet. The presumed reasons are as follows:

(1) Problem of the Detecting Process Time

In general, parcel inspections are performed while parcels are moving along a belt conveyor. If it takes too much time to inspect parcels for an explosive, the inspection area will become crowded. For example, when considering a conveyor speed (generally, 12 m/s), it is desirable to complete the inspection within several seconds (e.g. 8 seconds). From this aspect, the gas chromatograph method is not suitable because it takes too much time for detection. On the other hand, the mass spectrometric method is preferable because it requires only several seconds for detection and is highly reliable.

(2) Difficulty in Training Experts Who Have Special Technical Knowledge

At a parcel inspection area at an airport, it is necessary to have many devices to efficiently inspect for dangerous substances, such as explosives. Therefore, if special technical knowledge is required to operate, maintain, check, repair and make alterations or changes to dangerous substance inspection devices, it will be difficult to train personnel who have special technical knowledge.

(3) Safeguard Against Explosives

In the event that an explosive is detected, it is difficult to take proper precautions to protect people against the explosive. Conventionally, it is common to call public authorities (a police or fire station) and summon an explosive disposal team. In this case, specific precautions have to be taken according to the type, quantity, and shape of the explosive as well as a storage vessel of the explosive. Accordingly, if accurate information about the explosive has been obtained before the explosive disposal team is dispatched, appropriate precautions are expected to be taken. Also, it is preferable if appropriate protective precautions can be taken immediately.

A first purpose of the present invention is to provide an easily employable security system to make society safer.

A second purpose of the present invention is to increase the speed and reliability of inspecting dangerous substances.

A third purpose of the present invention is to ensure the safety of inspectors in the event that dangerous substances, such as explosives, have been detected.

In order to realize the above purposes, the present invention provides means to do so, as described hereafter.

First, the present invention applies the mass spectrometric method to a system for detecting dangerous substances. This reduces the inspection time (preferably to several seconds <3 to 8 seconds>) thereby making it easier to introduce this system.

Furthermore, a security service business is established, and the service company conducts equipment management that includes maintenance, checkups, adjustments, repairs, alteration, and changes of the entire security system including a dangerous substance inspection device and other operation administration. This enables users to easily introduce the security system. In a conventional business arrangement, a user who is a manager of an inspection area purchases a security system as property. In this case, leasing may be able to reduce initial equipment costs, however, a lot of effort is required to recruit and retain a certain number of personnel necessary for equipment management, train the personnel and also a large expense is required for other operation management. Considering this aspect, establishment of a security service business that specializes in operation administration of the security system is able to reduce at least equipment management costs that include maintenance and checkup expenses.

Moreover, a burden to a user will be further reduced by the security service enterprise dispatching personnel necessary for operation management and providing information.

It is also possible to divide the security system into two systems: a terminal system which has functions for inspecting for dangerous substances and is installed in an inspection area and a support system which is not necessarily installed in an inspection area. By connecting those systems with a communication line, such as a dedicated communication line or a public communication line (Internet, etc.), a security system can be established. In this case, for example, a required number of terminal systems are installed at one or more inspection areas, and the support system that supports those terminal systems can be installed in an office (e.g. one location) at the security service enterprise. Such a business arrangement is possible.

Besides, various other arrangements of the security service business can be considered. For example, a business arrangement in which a user purchases a terminal system, or a business arrangement in which a security service enterprise provides a user with a terminal system free of charge. According to the business arrangement, it is expected that the security service enterprise would charge (accounting) the user related costs of the security system, expenses of equipment management, such as maintenance, and operation administration and other service related costs.

In case of an event which is held for a limited time, it is preferable for the security service enterprise to provide the user with terminal systems free of charge. However, in both business arrangements mentioned above, it is easy for a user to introduce the security system because the user can rely on the security service enterprise to provide equipment management of terminal systems, such as maintenance, checkups, adjustments, repairs, alteration, and changes, and operation administration including personnel dispatch and information provision.

Specifically, an expected business arrangement is as follows: A terminal system which has mass spectrometric means for performing dangerous substance inspections is installed in an inspection area, and a support system is installed in a security service enterprise's office. Based on the mass spectrometric data on the target element to be inspected that has been measured by said mass spectrometric means, the support system determines whether or not a dangerous substance is present and identifies the type of the substance if such a substance exists. Said terminal system and said support system are connected via a communication network so that they can transmit information to each other, and said support system can send a determination result of dangerous substances to said terminal system via said communication network.

It is also possible to provide a user with mass spectrometric means for analyzing the mass of the target element to be inspected either at the user's expense or free of charge. Then, the security service enterprise receives, via a communication line, mass spectrometric data which has been analyzed by said mass spectrometric means, collates the received data with the reference data related to dangerous substances, and then sends the checked results to said user.

In the above-mentioned cases, said support system can integrate billing data for determination cost together with said determination results into the database and can also send the data and results to said terminal system.

A security system suitable for the above-stated security service businesses can be structured in various ways as described below.

(Terminal System)

A terminal system of the present invention comprises sampling means for sampling gases including the ambient air around a target object to be inspected, mass spectrometric means for analyzing the mass of the target gas to be inspected which has been sampled by said sampling means, communication means for sending and receiving information via a communication line, display means for displaying information, and control means for controlling said each means, wherein said control means outputs mass spectrometric data, which has been analyzed by said mass spectrometric means, to a communication line via said communication means, imports the determination result of a dangerous substance associated with said mass spectrometric data which has been received by said communication means via said communication line and then displays the result on said display means.

In place of this, a terminal system of the present invention can comprise sampling means for sampling gases including the ambient air around a target object to be inspected, mass spectrometric means for analyzing the mass of the target gas to be inspected which has been sampled by said sampling means, determination means for determining whether or not a dangerous substance is present in the target gas and identifying the type of the substance, based on the mass spectrometric data which has been analyzed by said mass spectrometric means, communication means for sending and receiving information via a communication line, display means for displaying information, and control means for controlling said each means, wherein when the determination result by said determination means indicates the presence of a dangerous substance, said control means issues a command to said mass spectrometric means to change analysis conditions and execute a mass spectrometric process, outputs the revised mass spectrometric data, which has been analyzed by said mass spectrometric means, to a communication line via said communication means, imports the determination result of a dangerous substance associated with said revised mass spectrometric data received by said communication means via said communication line and then displays the result on said display means.

Moreover, in addition to the terminal system mentioned above, it is possible to add a measuring device that measures the weight of said target object to be inspected, and an X-ray device that photographs an X-ray image of said target object, wherein when the determination result by said determination means indicates the presence of a dangerous substance, said control means imports the weight and X-ray image of said target object from said measuring device and said X-ray device, sends them to a communication line via said communication means and then displays a guide to precautions against said dangerous substance, on said display means, which has been received by said communication means via said communication line.

(Support System)

A support system of the present invention comprises determination means for determining whether or not a dangerous substance is present and identifying the type of the substance by collating mass spectrometric data of a mass spectrum with the reference data used for the determination of the dangerous substance, communication means for sending and receiving information via a communication line, and control means for controlling said each means, wherein said control means inputs said mass spectrometric data received by said communication means into said determination means and then outputs the determination result which is output by said determination means to said communication line via said communication means.

In place of this, a support system of the present invention can comprise first determination means for at least determining whether or not a dangerous substance is present by collating first mass spectrometric data of the target gas to be inspected with the first reference data, second determination means for determining whether or not a dangerous substance is present and identifying the type of the substance by collating second mass spectrometric data of the target gas with the second reference data, communication means for sending and receiving information via a communication line, and control means for controlling said each means, wherein said control means inputs the first mass spectrometric data received by said communication means into said first determination means, and outputs the first determination result which is output by said first determination means to said communication line via said communication means, and when the first determination result indicates the presence of a dangerous substance, said control means issues a command to change analysis conditions and measure second mass spectrometric data to a communication line via said communication means.

Moreover, in addition to the support system mentioned above, it is possible to add means for creating a guide to precautions against dangerous substances based on the weight and X-ray image of said dangerous substance, the type and shape of said dangerous substance and its storage vessel information which are received by said communication line via said communication means when the determination result indicates the presence of a dangerous substance. In this system, said control means can output said precautions guide to said communication line via said communication means.

(Security System)

A security system of the present invention can consist of the above-mentioned terminal system and support system being connected to each other via a communication line.

DETAILED DESCRIPTION OF THE PREFERRED EMBODIMENTS

Figure 1:
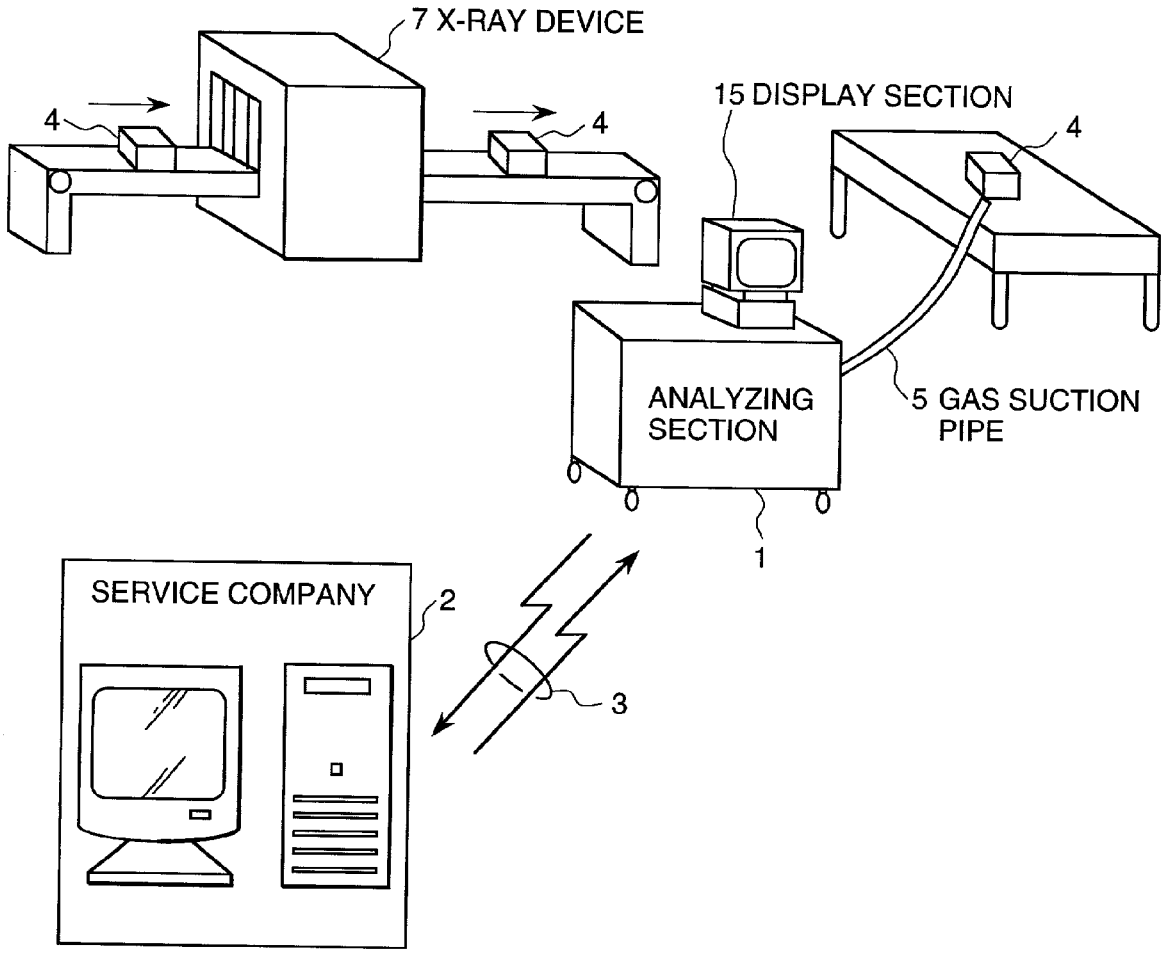
FIG. 1 shows a conceptual diagram of a security system which is an embodiment of the present invention.
Figure 2:
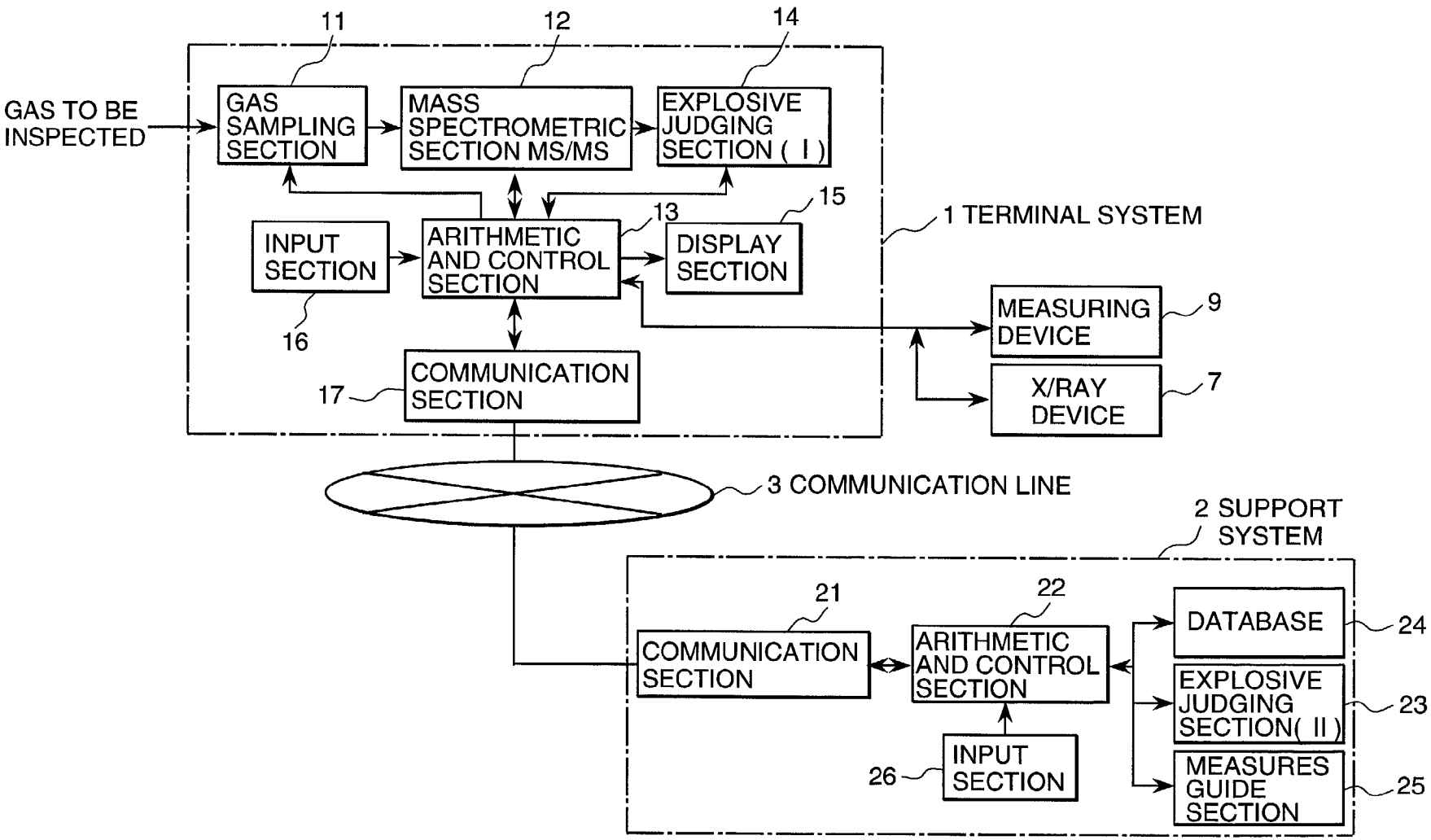
FIG. 2 is a block diagram of a security system which is an embodiment of the present invention.

An embodiment of the present invention which is applied to the inspection of explosives will be described in detail below, referring to FIG. 1 through FIG. 10. FIG. 1 is a conceptual diagram of a security system which is an embodiment of the present invention. FIG. 2 is a block diagram of a security system which is an embodiment of the present invention.

As shown in FIG. 1, a security system consists of a terminal system 1 installed at a parcel inspection area of an airport, which is a user, and a support system 2 installed in a service company, which is an office for a security service business. The terminal system 1 and the support system 2 are connected via a communication line 3 so that they can send and receive information between each other. The terminal system 1 comprises a gas suction pipe 5 which takes in a trace of gas, which is a target to be inspected, leaking from a parcel 4 together with the ambient air, and a display section 15 which displays information, such as results of dangerous substance inspections. Moreover, an X-ray device 7 is installed in an inspection area to photograph X-ray images of parcels 4 being moving along a belt conveyor 8 and to look at metals or the like through the fluoroscope.

With reference to FIG. 2, the structure and operational overview of a security system will be explained. A target gas to be inspected is taken in and channeled into a gas sampling section 11 of the terminal system 1 via the gas suction pipe 5. The gas which has been sampled by the gas sampling section 11 is channeled into a mass spectrometric section 12 where a mass spectrometric process of the sample gas is conducted. Mass spectrometric data obtained by the mass spectrometric section 12 is sent to an explosives determination section (I) 14 via an operational and control section 13. The explosives determination section (I) 14 collates the mass spectrometric data with reference data I and determines whether or not the sample gas contains an explosive element. If an explosive element is contained, the determination section (I) 14 provides the first-stage determination (MS1) about the type of the element. This determination result is output to the operational and control section 13 and then displayed on the display section 15. Furthermore, when the determination result indicates the presence of an explosive, the operational and control section 13 issues a command to the mass spectrometric section 12 to change analysis conditions and conduct the second-stage analysis. The second-stage mass spectrometric data which is output from the mass spectrometric section 12 is output to a communication line 3 by the operational and control section 13 via a communication section 17. As is commonly known, the communication section 17 organizes transmitted data into a specified transmission format, assigns a destination address, and then outputs the data to the communication line 3. When data in the communication line 3 is self-addressed, the communication section 17 imports the data. It is preferable to provide a function to encrypt and decrypt data as the need arises. Moreover, the operational and control section 13 imports X-ray images of parcels from an X-ray device 7 and data on the parcel weight from a measuring device 9.

Figure 3:
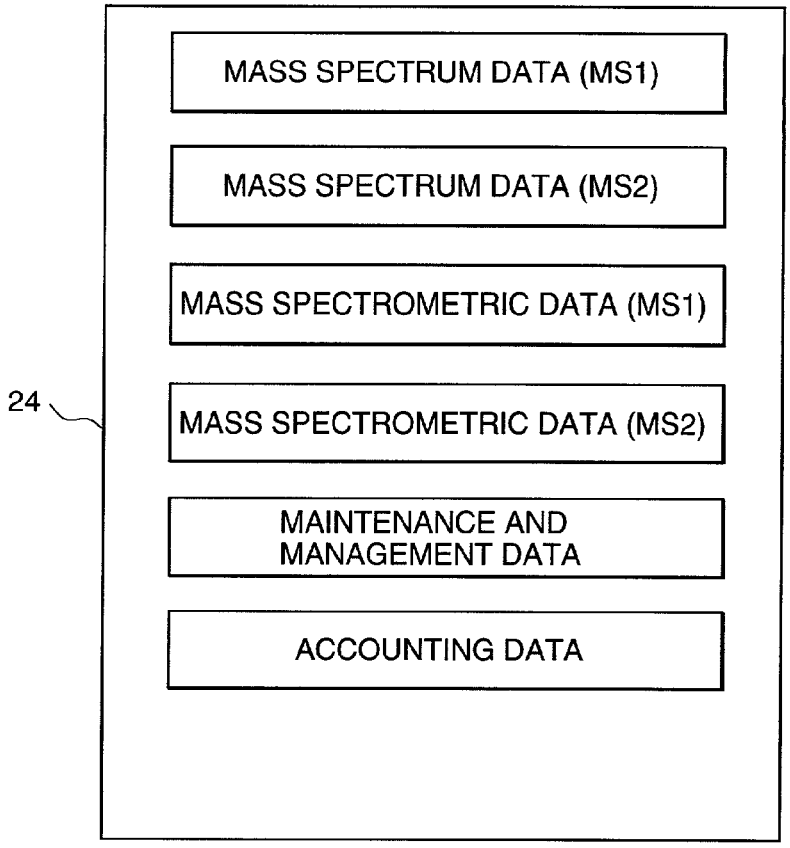
FIG. 3 shows an embodiment of a database 24 of the embodiment shown in FIG. 2.

The second-stage mass spectrometric data sent by the communication section 17 of the terminal system 1 is imported into the communication section 21 of the support system 2 via the communication line 3, and then sent to the explosives determination section (II) 23 via the operational and control section 22. The explosives determination section (II) 23 collates the second-stage mass spectrometric data with reference data II to provide the second-stage determination (MS2) that determines whether or not the sample gas contains an explosive element and identifies the type of the explosive if such an element is contained. The second-stage determination result is sent to the terminal system 1 via the operational and control section 22 and the communication section 21 and then displayed on the display section 15 of the terminal system 1. The communication section 21 has the same functions as the communication section 17 of the terminal system 1. Furthermore, the support system 2 comprises a database 24, a precautions guidance section 25 and an input section 26. As shown in FIG. 3, the database 24 is structured to store mass spectrum data (MS1), mass spectrum data (MS2), mass spectrometric data (MS1), mass spectrometric data (MS2), maintenance and management data, and accounting data.

Figure 4:
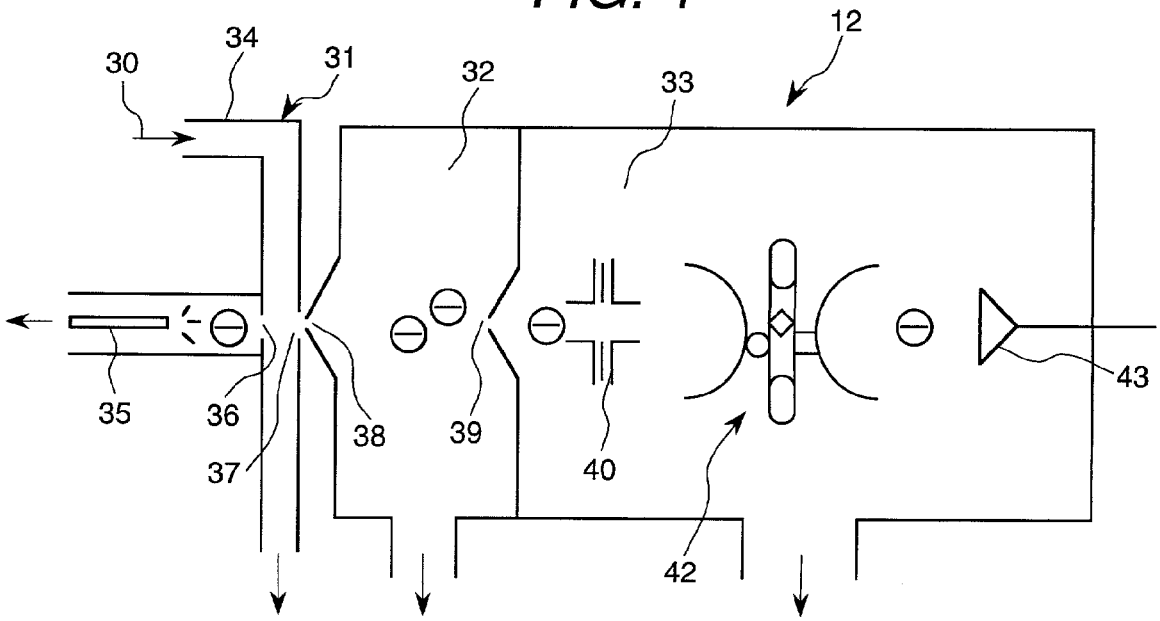
FIG. 4 is an explanatory drawing which illustrates the structure of the mass spectrometric section which adopts an ion trap mass spectrometer.

An ion trap mass spectrometer, shown in FIG. 4, is applied to the mass spectrometric section 12 of this embodiment. The mass spectrometric section 12 consists of a sample gas intake section 31, a decompression chamber 32, and a high vacuum chamber 33. The sample gas intake section 31 absorbs a target gas to be inspected 30 by using a vacuum pump through an inlet to the sample gas flow path 34. A needle electrode 35 is placed in the opening 36 of the sample gas flow path 34. The needle electrode 35 releases electrons by corona discharge and ionizes oxygen in the air (primary ionization). If an element characteristic of an explosive is contained in the target gas 30, ionized oxygen reacts with the molecules characteristic of the explosive and then ionizes those molecules (secondary ionization). Then, ions characteristic of explosives which have been generated under an atmospheric pressure are channeled through an opening 37 of the sample gas flow path 34 and through an opening 38 of the decompression chamber 32 into the decompression chamber 32, and then channeled through the opening 38 into the vacuum chamber 33. The ions characteristic of the explosive which have been channeled into the vacuum chamber 33 are carried through an ion convergence section 40 to an ion trapping section 41. The ion trapping section 41 consists of two end cap electrodes and one ring electrode. When ionized molecules of a target gas to be inspected are introduced into an area within these three electrodes, the ions are enclosed (i.e. trapped) in the electric field which has been formed by the high frequency voltage applied to the ring electrode. The trapped ions are released according to their mass as a result of being scanned by another high frequency voltage which has been applied to the end cap electrodes. Accordingly, it is possible to obtain a spectrum by detecting the released ions. Ions are stored in the electric field and released after a certain time duration (e.g. dozens of msec order). This integrated effect makes it possible to attain supersensitivity.

By analyzing the mass spectrum data of a sample gas obtained in the manner mentioned above, it is possible to inspect for the presence or absence of a mass spectrum which is characteristic of a dangerous substance, such as explosives, which might be present in the sample gas. Consequently, it is possible to determine the presence or absence of a dangerous substance, such as explosives, and if such a substance exists, the type of the substance can be identified.

This method requires only several seconds to detect an explosive (e.g. 3 to 8 seconds). And the reliability can be increased further by employing a multiplex analysis (MS/MS). In the multiplex analysis, only ions (parent ion) characteristic of explosives are separated from an ion mixture, then the parent ions are collided with helium gas to convert their kinetic energy into internal energy so as to generate fragment ions (daughter ion) coming from the parent ions, and then the daughter ions are detected.

To be more specific, in the first-stage (MS1) mass spectrometric process, a mass spectrum of ions (parent ion) which are characteristic of explosives is measured, and based on the MS1 mass spectrometric data, it is determined whether or not an explosive is present. To further increase the reliability, in the second-stage (MS2) mass spectrometric process, a mass spectrum of daughter ions is measured, and based on the MS2 mass spectrometric data, it is determined whether or not an explosive is present.

Figure 5:
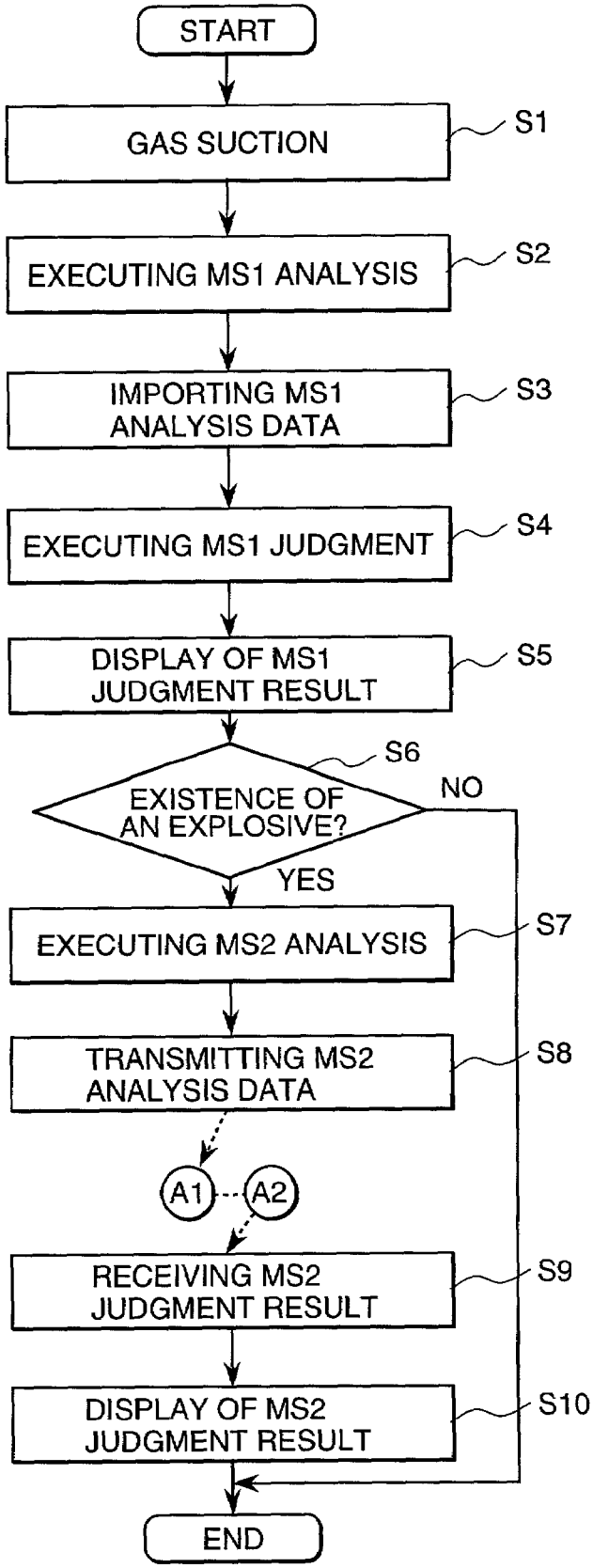
FIG. 5 is a processing flow chart of the operational and control section of the terminal system.
Figure 6:
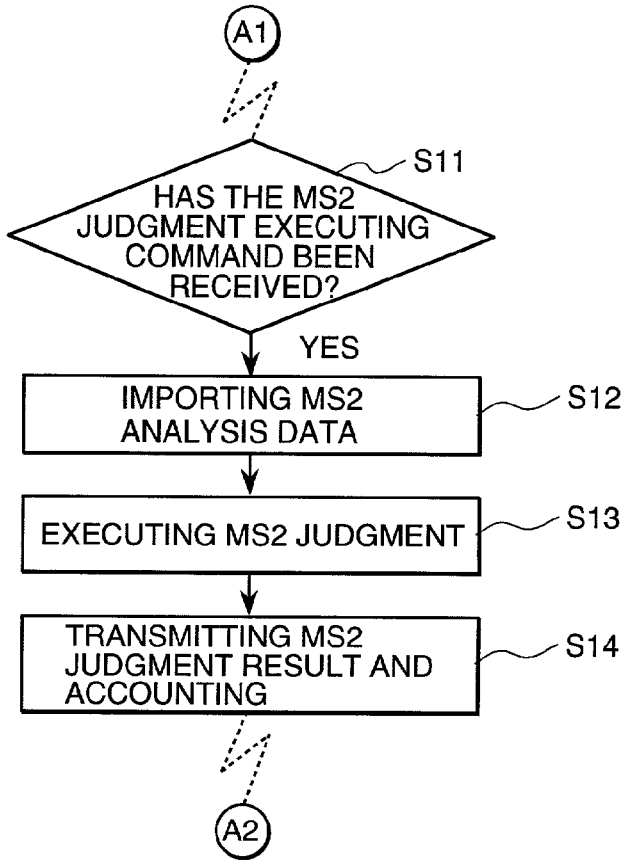
FIG. 6 is a processing flow chart of the operational and control section of the support system.

Detailed structure and operations of the security system mentioned above will be explained according to the flow charts shown in FIG. 5 through FIG. 9. FIG. 5 illustrates a processing procedure for the terminal system 1 and FIG. 6 illustrates a processing procedure for the support system 2.

The terminal system 1 starts a series of processes in response to the inspection start command which is input from the input section 16 into the operational and control section 13. The operational and control section 13 issues a command to the gas sampling section 11 to sample a specified quantity of target gas to be inspected (S1). The sample gas is channeled into the mass spectrometric section 12 where the first-stage (MS1) mass spectrometric process is executed according to the procedure explained in FIG. 4 (S2). The MS analysis provides a mass spectrum of sample gas elements as mass spectrometric data. For example, the mass spectrometric section 12 outputs mass spectrometric data on ion elements (parent ion) characteristic of explosives. The operational and control section 13 imports the mass spectrometric data and sends it to the explosives determination section (I) 14 (S3). The explosives determination section (I) 14 has stored preset reference data I which corresponds to the mass of the ion elements (parent ion) characteristic of explosives. And, the explosives determination section (I) 14 collates the input mass spectrometric data with the reference data I to determine whether or not the corresponding element is present (S4).

The determination result is displayed on the display section 5 via the operational and control section 13. When the determination result indicates "No explosive is present.", the operational and control section 13 ends the processing (S6).

On the other hand, if the determination result indicates "An explosive is present.", the operational and control section 13 issues a command to the mass spectrometric section 12 to execute the second-stage (MS2) analysis (S6). In response to this, the mass spectrometric section 12 executes the MS2 analysis (S7). In the MS2 analysis process, only ion elements (parent ion) are separated from an ion mixture which has been trapped in the MS1 analysis process, then the parent ions are activated, and finally fragment ions (daughter ion) coming from the parent ions are detected. By doing this, reliability of the explosives determination function can be increased.

The MS2 mass spectrometric data is sent to the communication section 17 via the operational and control section 13. The communication section 17 writes a command of executing MS2 determination together with MS2 mass spectrometric data into the transmission format addressed to the support system 2 and then outputs them to the communication line 3 (S8).

The command of executing MS2 determination and mass spectrometric data which have sent to the support system 2 are received by the communication section 21 of the support system 2 via the communication line 3. As shown in FIG. 6, the support system 2 confirms that the command of executing MS2 determination has been received by the operational and control section 22 (S11), imports the MS2 mass spectrometric data and then sends it to the explosives determination section (II) 23 (S12). The explosives determination section (II) 23 has stored preset reference data II which corresponds to the mass of the fragment ions (daughter ion) characteristic of explosives. The explosives determination section (II) 23 collates the input MS2 mass spectrometric data with reference data II to determine whether or not the corresponding element is present (S13). The MS2 determination result is sent to the communication section 21 via the operational and control section 22, is written into the transmission format addressed to the terminal system 1, and then output to the communication line 3 (S14). In cases where a contract has been made, a report on the MS2 determination is registered in the database 24 together with the accounting data (S14). Moreover, depending on a prior contract, it is possible to send the accounting data about the determination cost to the terminal system 1.

With reference to FIG. 5 again, the MS2 determination result sent to the terminal system 1 is received by the communication section 17 of the terminal system 1 via the communication line 3 (S9). Then, the operational and control section 22 will display the MS2 determination result on the display section 15 (S10). After a series of processes is finished, the explosives inspection procedure will end. If the MS2 determination result indicates "An explosive is present.", a precautions guidance function described later is activated.

The security system mentioned above, which detects an explosive by the mass spectrometric method, requires the relatively short inspection time and is highly reliable. Furthermore, because it employs a two-stage multiplex analysis (MS1/MS2) to inspect for an explosive, when the MS1 determination result indicates "No explosive is present.", the inspection can be finished. As a result, the inspection time can be reduced thereby helping to prevent jams in an inspection area.

In particular, because the terminal system 1 is equipped with the explosives determination section (II) 14, when the determination result indicates "No explosive is present.", the time spent communicating with the support system 2 becomes unnecessary, which increases inspection efficiency. In the event that the MS1 determination result is doubtful, re-determination is to be conducted by executing an MS2 analysis. Consequently, reliability can be further increased.

Figure 7:
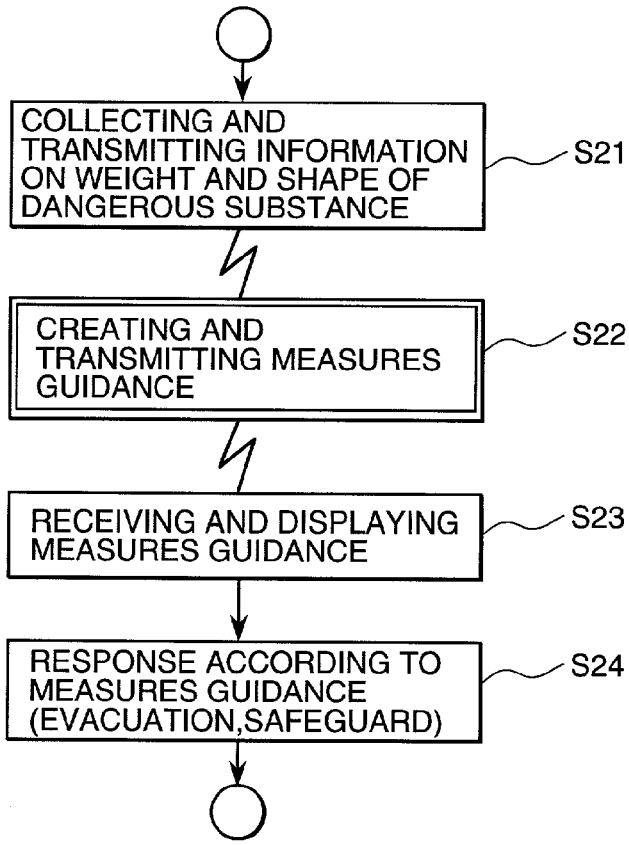
FIG. 7 is a processing flow chart of precautions guidance provided by the operational and control section of the terminal system.

FIG. 7 shows a processing procedure when the MS2 determination result indicates "An explosive is present.". In this drawing, single lines illustrate a processing block of the terminal system 1 and double lines illustrate a processing block of the support system 2.

(S21)

When the terminal system 1 receives the determination result that indicates the presence of an explosive from the support system 2, it issues a command to the X-ray device 7 and the measuring device 8 to request transmission of the weight and X-ray image (shape information) record of the parcel 4 being inspected so as to collect data. If no such record exists, the terminal system 1 requests that a measurement and X-ray photograph of the parcel 4 be made. Collected weight data and X-ray images are sent to the support system 2 via the communication section 17. The transmission procedure conducted by the communication section 17 are the same as mentioned above.

(S22)

The communication section 21 of the support system 2 receives the weight data and X-ray images of the parcel 4 and send them to the operational and control section 22. The operational and control section 22 sends the precautions guidance section 25 the weight data and X-ray images of the parcel 4 and the type of the explosive, which has been identified by the explosives determination section (11) 23, together with a command to create a guide to precautions against an explosive contained in the parcel 4. The precautions guidance section 25 calculates the weight of the explosive based on the weight and X-ray image of the parcel 4 and estimates the power of the explosion by considering the type of explosive. In this case, the presence or absence of a detonating device, such as a fuze or primer detonator, is determined by analyzing the pixel of the X-ray image. Then, based on the data obtained in such a manner, a guide to precautions against the parcel 4 is created. The created precautions guide is sent to the terminal system 1 by the operational and control section 22 via the communication section 21. The precautions guide, for example, includes the following:

(1) Information on Composition of the Explosive and its Name (Popular Name or General Name)

(2) Precautions to be Taken

<1>Necessity of Evacuation

<2>Necessity of Shielding the Object to be Inspected in a Protective Vessel

<3>Necessity of Detaining the Individual(s) who Possessed the Explosive

<4>Necessity of Contacting and Notifying the Proper Authorities Concerned

Necessary precautions are determined depending on the composition and type of the explosive. When necessary precautions are determined, each of the precautions is prioritized.

(S23, S24)

The terminal system 1 receives the precautions guide and sends it to the display section 15 to display the guide. The precautions guide can also be printed out. This enables inspectors to take precautions for evacuation or safeguards according to the precautions guide displayed on the display section 15 thereby protecting people from being harmed and ensuring safety. If a facility which protects against explosions, such as a protective shelter, is installed in an inspection area, the protective shelter will be automatically operated to confine the parcel containing the explosive so as to isolate the parcel from people.

By providing the precautions guidance section 23 in the support system 2, a user of the terminal system 1 can take proper precautions by referring to the precautions guide displayed on the display section 15 even though the user does not have sufficient technical knowledge about explosives.

Figure 8:
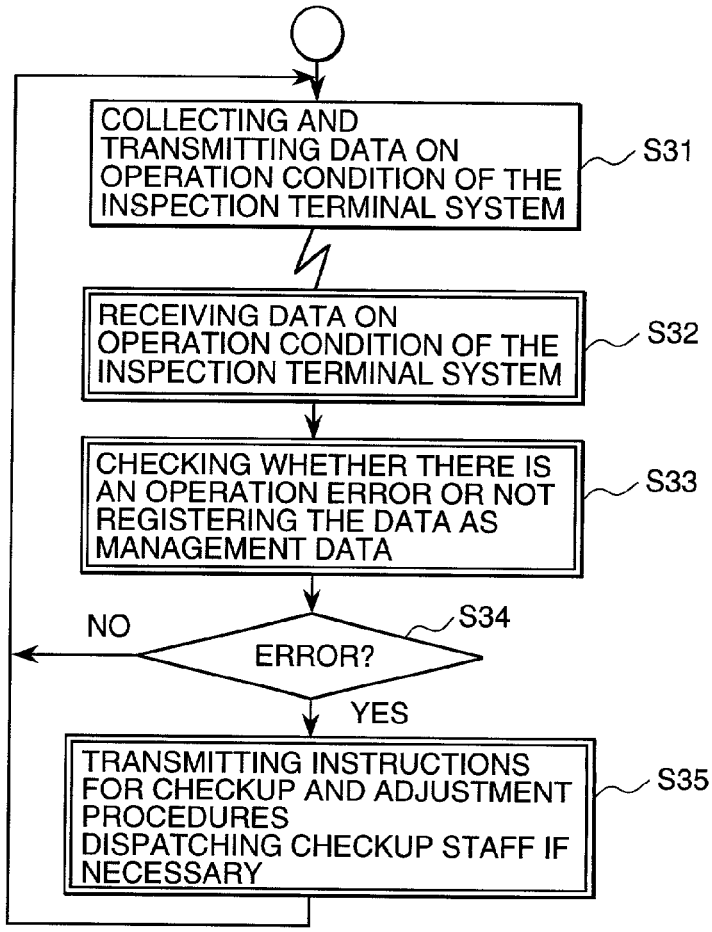
FIG. 8 is a processing flow chart of precautions guidance provided by the operational and control section of the support system.

FIG. 8 shows a flow chart of a processing procedure for the management of operation condition of the terminal system 1. In this drawing, single lines illustrate a processing block of the terminal system 1 and double lines illustrate a processing block of the support system 2.

(S31)

The operational and control section 13 of the support system 1 periodically collects data on operation condition of each section during normal operation. The collected operation condition data is then sent to the support system 2 via the communication section 17.

(S32)

The support system 2 receives the operation condition data of the terminal system 1 and stores it in the database.

(S33)

The operational and control section 22 checks the operation condition data of the terminal system 1 according to the maintenance and management data stored in the database 24, determines whether or not an error is present, and then registers the data in the database.

(S34, S35)

If the operational and control section 22 has found an error in the terminal system 1, it retrieves the checkup and adjustment procedures for correcting the error which have been stored in the maintenance and management data and sends them to the terminal system 1. The terminal system 1 checks the system according to the transmitted checkup and adjustment procedures and makes adjustments. The security service enterprise can dispatch checkup staff if necessary.

Thus, a user of the terminal system 1 can be aided by the support system 2 from the security service enterprise even though the user does not have sufficient knowledge about operation management. As a consequence, the user can devote itself to inspection operations.

Figure 9:
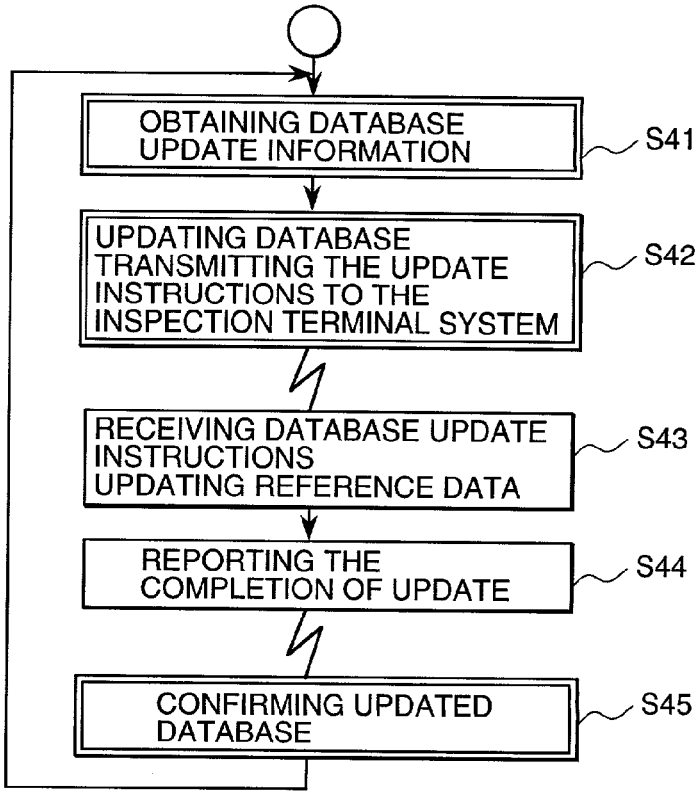
FIG. 9 is a processing flow chart of updating the database of the security system.

FIG. 9 shows a flow chart of updating the database 24.

Basically, as mentioned previously, typical explosives can be handled, however, explosives are easily altered into various types. Therefore, it becomes necessary to change reference data I and II and MS2 analysis conditions which may affect determination of explosives. To cope with such a case, it is preferable to provide a database update function as shown in FIG. 9. In this drawing, single lines illustrate a processing block of the terminal system 1 and double lines illustrate a processing block of the support system 2.

As shown in FIG. 9, when the support system 2 obtains information for updating the database from a manufacturer of explosives via online or via other communication means (S41), the support system 2 updates data stored in its own database 24, and when the update data is related to the terminal system 1, the support system 2 sends the terminal system 1 an instruction to update its data (S42). In response to this, when the terminal system 1 receives the instruction to update its data, if the changes are for the reference data I, the terminal system 1 accesses the explosives determination section (I) 14 to update the reference data I. If the changes are for analysis conditions of MS1 or MS2, it accesses the mass spectrometric section 12 to update those analysis conditions (S43). When finishing the update, the terminal system 1 sends an update completion report to the support system 2 (S44). The support system 2 receives and confirms the database update completion report and then finishes the processing procedure (S45).

Figure 10:
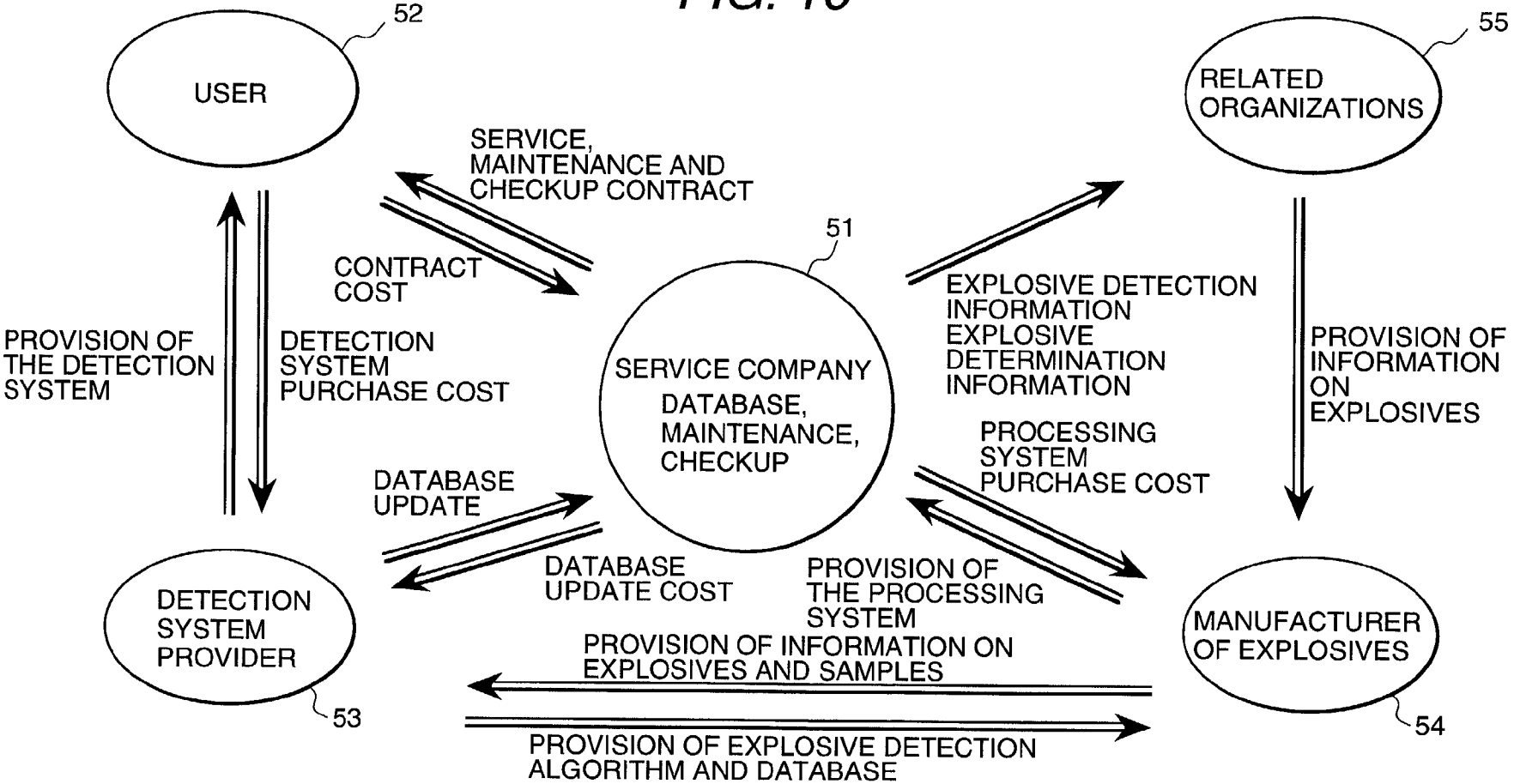
FIG. 10 shows a conceptual diagram of a security service business which employs a security system that is an embodiment of the present invention.

Next, FIG. 10 shows a conceptual diagram of an embodiment of a security service business which employs the security system shown in FIG. 2. As shown in the drawing, this embodiment places a service company 51, which is an office of a security service enterprise, at its center and organically combines a user 52, detection system provider 53, a manufacturer of explosives 54, and organizations concerned 55, such as public authorities. When a user 52 operates a terminal system installed at the user's inspection area, the service company 51 supports various administrative tasks which include a variety of services, maintenance, and checkups associated with the inspection and determination of dangerous substances (explosives) and precautions to be taken so that it can receive payment for the cost which has been specified by a contract. Furthermore, the service company 51 purchases database update information from the detection system provider 53 and pays for the cost. The service company 51 also purchases a dangerous substance (explosives) treatment system (e.g. protective device, etc.) from a manufacturer of explosives 54 and pays for the cost.

Moreover, in accordance with laws and regulations, the service company 51 notifies proper authorities concerned 55 and gives them information about explosives, specifically, the fact that an explosive has been detected and the identity of the explosive, such as type and quantity.

In this example, the detection system provider 53 furnishes the user 52 with a detection system for the terminal system 1 and receives payment for the purchase cost. The manufacturer of explosives 54 provides the detection system provider 53 with information on explosives and samples which are useful for updating the database of the detection system and improving the system. Then, the detection system provider 53 provides the algorithm and database for detecting explosives. Furthermore, the manufacturer of explosives 54 receives information about altered explosives from the proper authorities concerned 55, and then to utilize the information for the security system, the manufacturer of explosives 54 notifies the service company 51 and the detection system provider 53 of various information and changes to the database.

Figure 11:
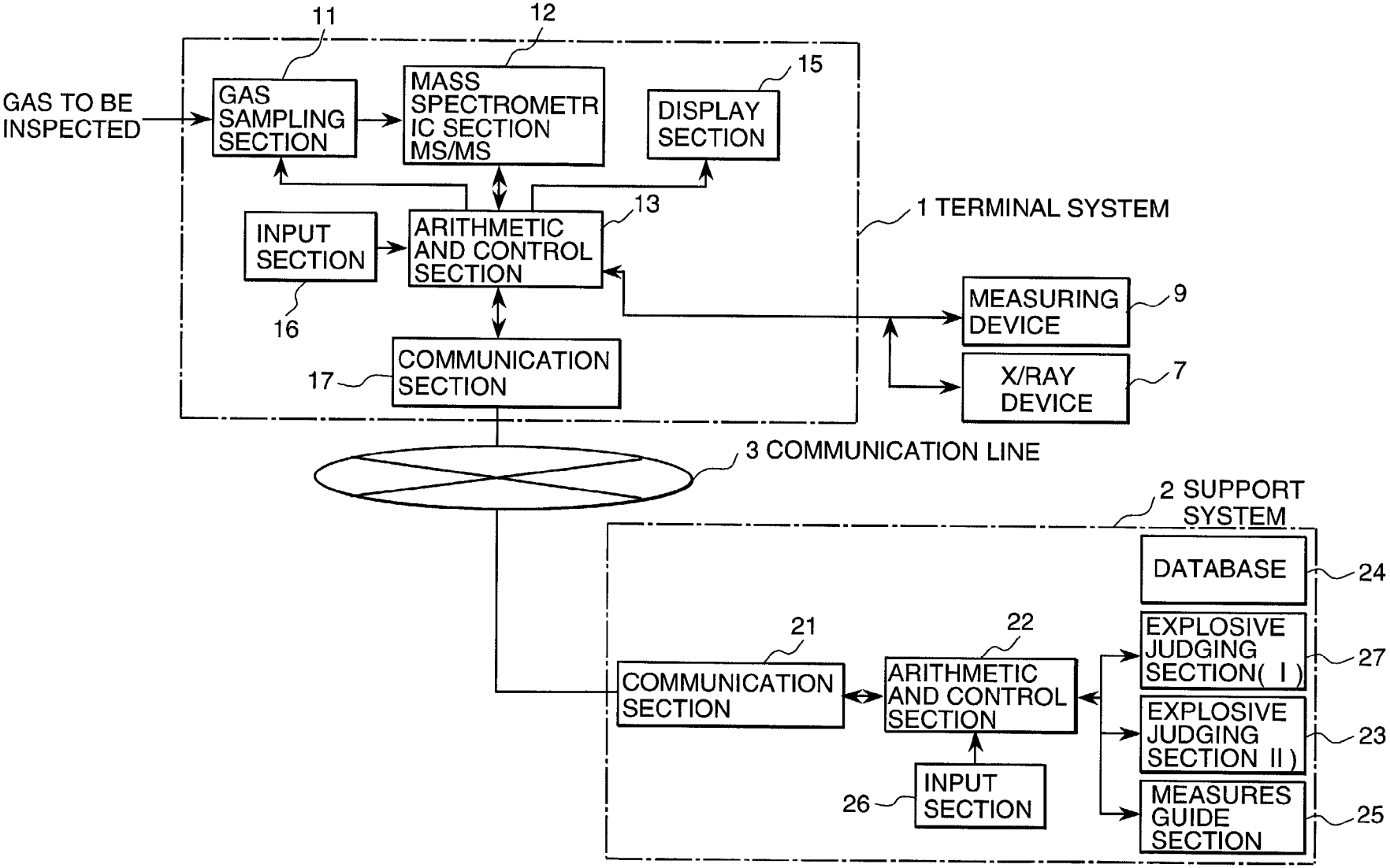
FIG. 11 is a block diagram of a security system which is another embodiment of the present invention.
Figure 12:
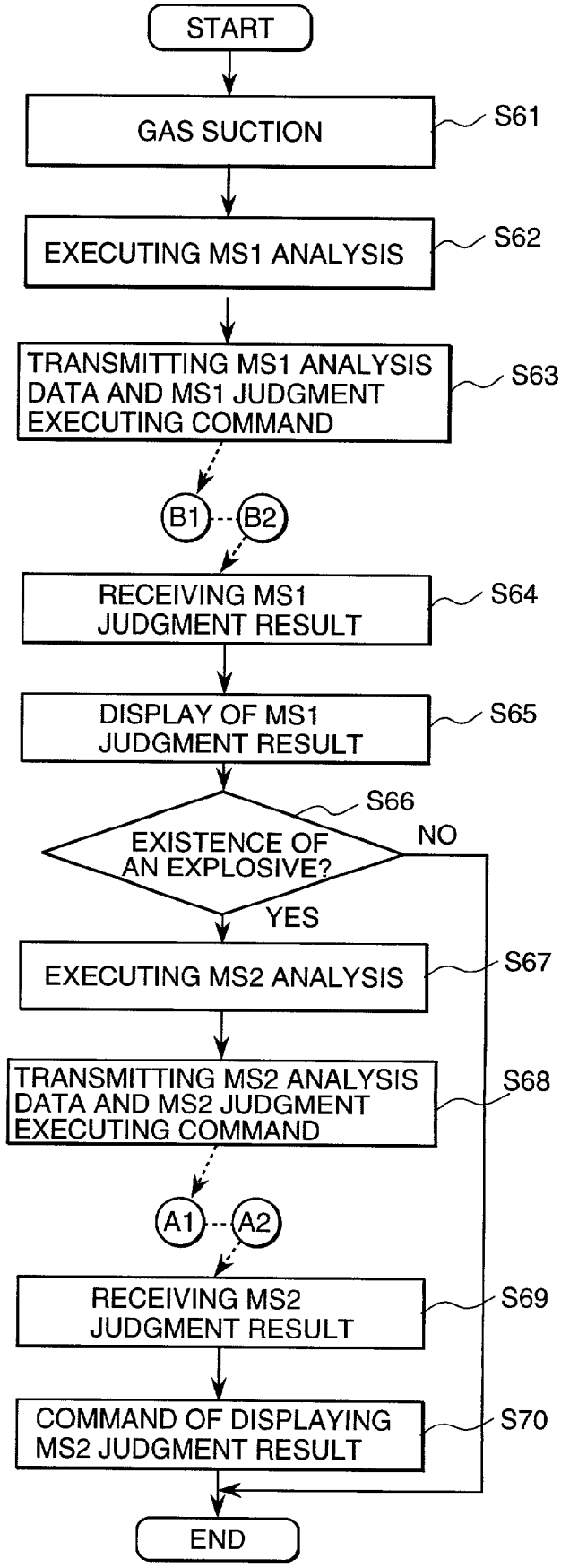
FIG. 12 is a processing flow chart of the operational and control section of the terminal system which is an embodiment shown in FIG. 11.
Figure 13:
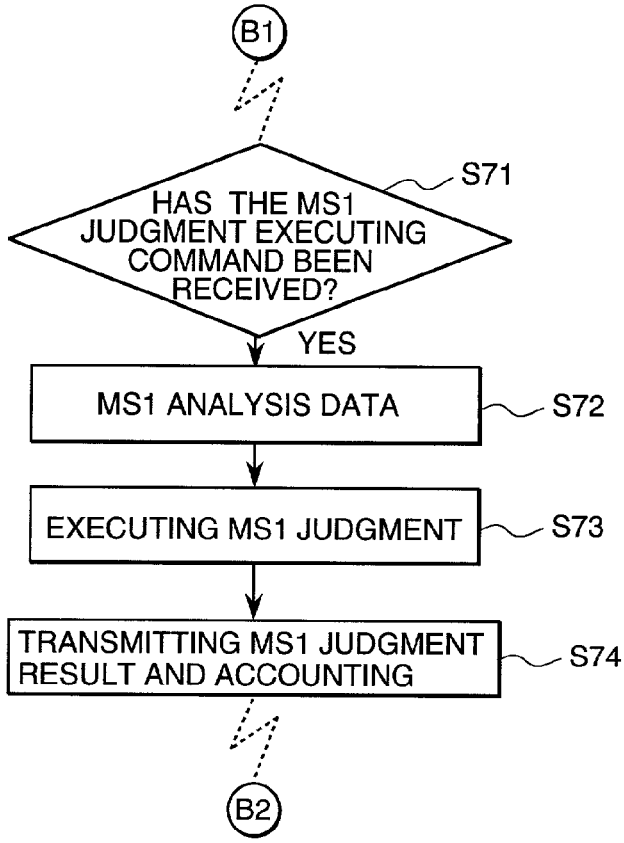
FIG. 13 is a processing flow chart of the operational and control section of the support system which is an embodiment shown in FIG. 11.

Next, FIG. 11 shows a block diagram of a security system which is another embodiment of the present invention, and FIG. 12 and FIG. 13 show the flow charts of the processing procedure. As shown in those drawings, the difference between this embodiment and the embodiment shown in FIG. 2 through FIG. 9 is that the explosives determination section (I) 14 of the terminal system 1 is moved to the support system 2. Functionally, the explosives determination section (I) 27 of the support system 2 is not different from the explosives determination section (I) 14.

According to this embodiment, as shown in flow charts illustrated in FIGS. 12, 13 and 6, both MS1 and MS2 analysis data is transmitted to the support system 2, and then the support system 2 checks and determines the both MS1 and MS2 analysis data.

The terminal system 1 starts a series of processes in response to the inspection start command which is input into the operational and control section 13 from the input section 16. The operational and control section 13 issues a command to the gas sampling section 11 to sample a specified quantity of the target gas to be inspected (S61). The sample gas is channeled into the mass spectrometric section 12 where the first-stage (MS1) mass spectrometric process is executed according to the procedures described in FIG. 4 (S62). Mass spectrometric data obtained by the MS1 analysis is sent to the support system 2 together with a command of executing MS1 determination by the operational and control section 13 (S63).

As shown in FIG. 13, when receiving the command of executing MS1 determination (S71), the support system 2 sends mass spectrometric data to the explosives determination section (I) 27 to execute the determination (S72). The explosives determination section (I) 27 collates the input mass spectrometric data with reference data I to determine whether or not the corresponding element is present (S73). The determination result is sent to the terminal system 1 via the operational and control section 22 (S74). At this point, the operational and control section 22 stores the determination result and accounting data in the database 24. The accounting data is also sent to the terminal system 1.

With reference to FIG. 12 again, the terminal system 1 receives the MS1 determination result (S64) and displays the result on the display section 15 (S65). When the MS1 determination result indicates "No explosive is present.", the operational and control section 13 finishes processing. When the determination result indicates "An explosive is present.", the operational and control section 13 sends a command to the mass spectrometric section 12 to execute the second-stage (MS2) analysis (S66). In response to this, as in the same manner as the embodiment shown in FIG. 1, the mass spectrometric section 12 executes the MS2 analysis (S67). The MS2 mass spectrometric data and the command of executing determination are sent to the support system 2 via the communication section 17 (S68).

In response to this, as shown in FIG. 6, the support system 2 confirms that the command of executing MS2 determination has been received by the operational and control section 22 (S11), imports the MS2 mass spectrometric data and then sends it to the explosives determination section (II) 23 (S12). The explosives determination section (II) 23 collates the input MS2 mass spectrometric data with reference data II to determine whether or not the corresponding element is present (S13). The MS2 determination result is sent to the communication section 21 via the operational and control section 22 and then output to the communication line 3 (S14). In cases where a contract has been made, a report on the MS2 determination is registered in the database 24 together with the accounting data (S14). Moreover, depending on a prior contract, it is possible to send accounting data on the determination cost to the terminal system 1.

With reference to FIG. 12 again, the operational and control section 22 of the terminal system 1 receives the MS2 determination result via a communication line 3 (S69) and displays the result on the display section 15 (S70). After a series of processes is finished, the explosives inspection procedure will end. If the MS2 determination result indicates "An explosive is present.", a precautions guidance function described in FIG. 7 is activated.

According to this embodiment, the same effect can be expected as the embodiment shown in FIG. 2. Also, this embodiment has an advantage of being able to avoid leaks of confidential information, such as know-how related to explosives determination (I) because the service company's support system 2 can store reference data I and II which are required for the explosives determination.

In the embodiment shown in FIG. 2 or FIG. 11, when the MS1 determination result indicates the presence of an explosive, the operational and control section 13 or the operational and control section 22 issues a command to the mass spectrometric section 12 to execute MS2. But, not limited to this, when the present invention is applied to explosives detection, it is possible to program for the mass spectrometric section 12 to continuously conduct MS1 and MS2 mass spectrometric processes. For inspecting for an explosive, it is possible to specify MS2 analysis conditions without waiting for the MS1 mass spectrometry result. In this case, the operational and control section 13 temporarily saves mass spectrometric data I and II which is continuously output from the mass spectrometric section 12, and in the event that the MS1 determination result indicates the presence of an explosive, the operational and control section 13 outputs mass spectrometric data II to the explosives determination section (II).

Figure 14:
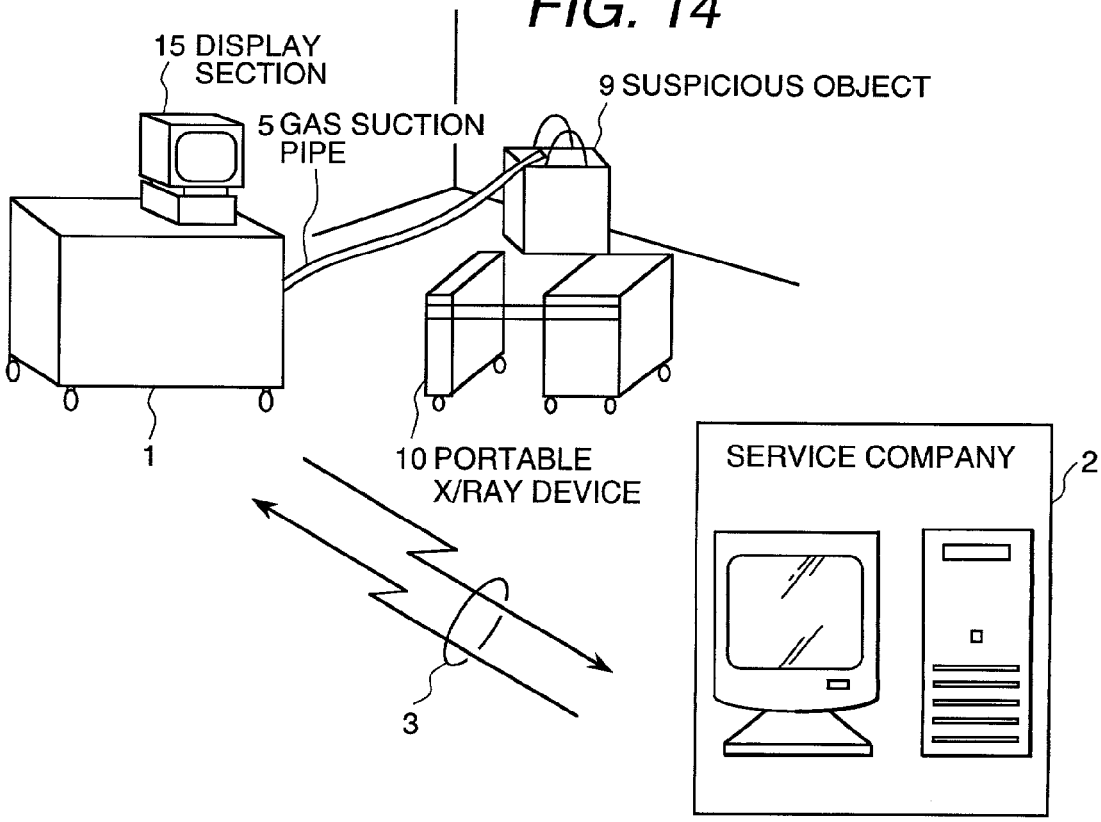
FIG. 14 shows a conceptual diagram of a security system which is another embodiment of the present invention.

FIG. 14 shows a conceptual diagram of a security system which is another embodiment of the present invention. This embodiment is applied to a security system for inspecting suspicious objects located at ordinary places. The terminal system 1 and the support system 2 are the same as the embodiment shown in FIG. 2 through FIG. 9. As shown in the drawings, the terminal system 1 absorbs the ambient air around a bag 9 by means of a suction pipe and then inspects for the presence or absence of a dangerous substance. In such a case, X-ray devices are not always installed and it is expected that a portable X-ray device 10 will be provided by a service company.

Each embodiment mentioned above explains security systems which detect explosives. However, the present invention is not limited to detecting explosives, but can be adopted by a security service business of inspecting dangerous substances and providing precautions to be taken. Besides explosives, dangerous substances include gunpowder, poisonous gases, inflammables, and other material which are generally harmful to people and society. Inspections for the presence or absence of such material and determination of the type of the material can be done by using mass spectrometry to detect ion elements characteristic of the material, in the same manner as the inspection of explosives mentioned above.

According to the present invention, it is possible to employ a security system thereby making society safer. It is also possible to increase inspection speed and reliability. Furthermore, in cases where the system can display a precautions guide when explosives are detected, it is possible to ensure the safety of inspection staff located in an inspection area.

The invention claimed is:

1. A security terminal system for determinating a kind or existence of dangerous substance having a terminal system provided in an inspection room of said dangerous substance and a support system connected to said terminal system through a communication line, said terminal system comprises a sampling means for sampling a substance to be inspected, a analyzing means for analyzing said substance to be inspected, a first determination means having a first standard data for determinating said dangerous substance based on analyzing data obtained by said analyzing means, a communication means for communicating with said support system through said communication line, a display means, and a control means for controlling said each means of said terminal system, said support system comprises a communication means for communicating with said terminal system through said communication line, a database for storing at least data relating to determination of said dangerous substance, a second determination means for determinating said dangerous substance by comparing said analyzing data received from said terminal system, and a control means for controlling said each means of said support system, wherein said first determination means of said terminal system performs a first determination to determine said kind and said existence of said dangerous substance by comparing said analyzing data with said first standard data, when said first determination means determines said existence of said dangerous substance, said control means of said terminal system performs a second analyzing process in said analyzing means, and transmits an analyzing data obtained by said second analyzing process to said support system through said communication means of said terminal system, and said second determination means of said support system has second standard data, and performs a second determination to determine said kind and said existence of said dangerous substance by comparing said analyzing data obtained by said second analyzing process and received from said terminal system through said communication means with said second standard data.

2. A security terminal system as claimed in claim 1, wherein said sampling means samples air around said substance to be inspected, and said analyzing means for analyzing is a mass spectrometric means for analyzing a mass of said substance to be inspected which is sampled by said sampling means.

3. A security terminal system as claimed in claim 2, wherein said mass spectrometric means is one for performing ion trap type mass analyzing, and comprises a sample gas intake section, a decompression chamber, and a high vacuum chamber, in said sample gas intake section, oxygen contained in the sampled air is ionized by emitting electrons by corona discharge, and the ionized oxygen reacts with molecules characteristic of the explosive and then ionized again those molecules so as to be trapped, and mass spectrum data of the sample gas are detected with an ion detector in said high vacuum chamber.

4. A security terminal system as claimed in claim 3, wherein said first standard data corresponds to said mass spectrum data of ion of said molecules characteristic of the explosive, as a first determination performed by said first determination means, the existence of said ions of the said molecules characteristic of the explosive is judged by comparing said mass spectrum data with said first standard data.

5. A security terminal system as claimed in claim 4, wherein said second standard data corresponds to said mass spectrum data of fragment ions generated by converting kinetic energy into internal energy, said kinetic energy being obtained by colliding helium gas, as a second determination performed by said second determination means, the existence and kind of said ions of the said molecules characteristic of the explosive is judged by comparing said mass spectrum data obtained by said second determination with said second standard data.

6. A security terminal system as claimed in claim 1, wherein said terminal system comprises a measuring device that measures weight of said substance to be inspected, and a X-ray device that photographs an X-ray image of said substance to be inspected, and said control means of said terminal system transmits said weight and said X-ray image from said measuring device and said X-ray device to said support system through said communication means when said first determination means determines said dangerous substance.

7. A security terminal system as claimed in claim 6, wherein said support system further comprises a processing guidance part and provides a guidance for a corresponding processing of said substance to be inspected based on a result of said second determination and said weight and received from said terminal system, and said control means of said terminal system controls said display means so as to display said guidance received thereby.

8. A security terminal system for determinating a kind or existence of dangerous substance having a terminal system provided in an inspection room of said dangerous substance and support system connected to said terminal system through a communication line, said terminal system comprises a sampling means for sampling substance to be inspected, an analyzing means for analyzing said substance to be inspected, a determination means having a standard data for determining said dangerous substance based on analyzing data obtained by said analyzing means, a communication means for communicating with said support system through said communication line, a display means and a control means for controlling said each means of said terminal system, wherein said determination means of said terminal system performs a determination to determine said kind and said existence of said dangerous substance by comparing said analyzing data with said first standard data, when said determination means determines said existence of said dangerous substance, said control means performs a second analyzing process in said analyzing means, and transmits an analyzing data obtained by said second analyzing process to said support system through said communication means.

9. A security terminal system for determinating a kind or existence of dangerous substance having a terminal system provided in an inspection room of said dangerous substance and support system connected to said terminal system through a communication line, said support system comprises a communication means for communicating with said terminal system through said communication line, a database for storing at least data relating to determination of said dangerous substance, a determination means for determinating said dangerous substance contained in substance to be inspected by comparing said analyzing data received from said terminal system, and a control means for controlling said each means of said support system, wherein when said determination means determines said existence of said dangerous substance as a result of a first determination in said terminal system, said support system receives an analyzing data transmitted from said terminal system, and said determination means has standard data, and performs second determination to determine said kind and said existence of said dangerous substance by comparing said analyzing data received from said terminal system through said communication means with said standard data.

* * * * *